US012000605B2

(12) United States Patent
Zhuo et al.

(10) Patent No.: US 12,000,605 B2
(45) Date of Patent: Jun. 4, 2024

(54) METHOD FOR CONTROLLING BALANCED FROSTING OF OUTDOOR UNITS IN MULTI-SPLIT AIR-CONDITIONING SYSTEM

(71) Applicants: Qingdao Haier Air-conditioning Electronic Co., Ltd, Shandong (CN); Haier Smart Home Co., Ltd., Shandong (CN)

(72) Inventors: Baitian Zhuo, Qingdao (CN); Bin Shi, Qingdao (CN); Shaojiang Cheng, Qingdao (CN); Ruigang Zhang, Qingdao (CN); Jun Wang, Qingdao (CN)

(73) Assignees: Qingdao Haier Air-conditioning Electronic Co., Ltd, Shandong (CN); Haier Smart Home Co., Ltd., Shandong (CN)

( * ) Notice: Subject to any disclaimer, the term of this patent is extended or adjusted under 35 U.S.C. 154(b) by 327 days.

(21) Appl. No.: 17/641,973

(22) PCT Filed: Sep. 4, 2020

(86) PCT No.: PCT/CN2020/113395
§ 371 (c)(1),
(2) Date: Mar. 10, 2022

(87) PCT Pub. No.: WO2021/052193
PCT Pub. Date: Mar. 25, 2021

(65) Prior Publication Data

US 2022/0307713 A1 Sep. 29, 2022

(30) Foreign Application Priority Data

Sep. 17, 2019 (CN) ..... 201910877989.7

(51) Int. Cl.
*F24F 11/42* (2018.01)
*F24F 11/64* (2018.01)

(52) U.S. Cl.
CPC ..... *F24F 11/42* (2018.01); *F24F 11/64* (2018.01)

(58) Field of Classification Search
CPC .. F24F 11/42; F24F 11/62; F24F 11/64; F24F 1/68; F24F 11/65; F24F 11/30; F24F 11/63; F25B 47/02; F25D 21/06; Y02B 30/70
See application file for complete search history.

(56) References Cited

U.S. PATENT DOCUMENTS 5,186,016 A 2/1993 Nigo
5,319,943 A * 6/1994 Bahel ..... F25B 47/025 62/211

(Continued)

FOREIGN PATENT DOCUMENTS

CN 102706054 10/2012
CN 109798600 5/2019

(Continued)

OTHER PUBLICATIONS

International Search Report mailed Dec. 4, 2020, in corresponding to International Application No. PCT/CN2020/113395; 5 pages (with English Translation).

*Primary Examiner* — Darrin D Dunn
(74) *Attorney, Agent, or Firm* — Maier & Maier, PLLC

(57) ABSTRACT

A method for controlling the balanced frosting of outdoor units in a multi-split air-conditioning system solving the problem in existing multi-split air-conditioning systems of resource waste caused by a low utilization efficiency of the heating capability of outdoor units as a result of some of the outdoor units entering a defrosting state when the heating capability is not fully utilized. According to the control (Continued)

method, by determining whether an outdoor unit set satisfies a frosting unbalance condition, the actual output capability of outdoor units of the outdoor unit set is selectively controlled on the basis of the frosting degrees of all the outdoor units. Thus, the difference between the frosting degrees of different outdoor units in the outdoor unit set at the same time can be reduced, such that the heating capability of all the outdoor units can be fully utilized when the outdoor unit set enters a defrosting state.

10 Claims, 2 Drawing Sheets

(56) References Cited

U.S. PATENT DOCUMENTS 6,263,686 B1 * 7/2001 Burkhart ..... F25D 21/008 62/155
7,403,827 B2 * 7/2008 Itoh ..... G05B 15/02 700/65
10,914,503 B2 * 2/2021 Walser ..... F25D 21/08
11,920,808 B2 * 3/2024 Yoshimoto ..... F24F 11/46
2006/0207269 A1 * 9/2006 Jung ..... F24F 11/30 62/130
2008/0179410 A1 * 7/2008 Yoon ..... F24F 11/30 236/51
2009/0259345 A1 * 10/2009 Kato ..... G06F 1/20 718/1
2012/0083927 A1 * 4/2012 Nakamura ..... F24F 11/64 700/278
2012/0153725 A1 * 6/2012 Grohman ..... H01Q 1/243 307/39
2012/0161517 A1 * 6/2012 Kim ..... H02J 3/14 307/31
2013/0111492 A1 * 5/2013 Nojiri ..... G06F 1/206 718/104
2015/0159929 A1 * 6/2015 Hancock ..... F25B 27/02 62/238.4
2016/0161165 A1 * 6/2016 Ushijima ..... F24F 11/63 62/155
2016/0265799 A1 * 9/2016 Matsuno ..... F24F 11/56
2017/0205101 A1 * 7/2017 Chen ..... G05B 19/05
2017/0292726 A1 * 10/2017 Sato ..... F24F 11/72
2018/0172309 A1 * 6/2018 Niikura ..... F24F 11/46
2019/0242604 A1 * 8/2019 Wan ..... F25B 13/00
2019/0257568 A1 * 8/2019 Buda ..... F25D 21/06
2022/0026126 A1 * 1/2022 Miura ..... F25B 13/00
2022/0146133 A1 * 5/2022 Miyake ..... F24F 11/62
2022/0177764 A1 * 6/2022 Itano ..... C09K 5/045
2022/0333837 A1 * 10/2022 Yang ..... F24F 1/06
2022/0390138 A1 * 12/2022 Jaber ..... F24F 11/67
2023/0273580 A1 * 8/2023 Nakagawa ..... H02J 13/00006 700/295
2023/0366574 A1 * 11/2023 Zhang ..... F24F 11/88

FOREIGN PATENT DOCUMENTS

CN 110057029 A 7/2019
CN 110173939 A 8/2019

* cited by examiner

METHOD FOR CONTROLLING BALANCED FROSTING OF OUTDOOR UNITS IN MULTI-SPLIT AIR-CONDITIONING SYSTEM

FIELD

The present disclosure relates to the technical field of air conditioning; in particular, the present disclosure relates to a method for controlling balanced frosting of outdoor units in a multi-connection air conditioning system.

BACKGROUND

A multi-connection air conditioning system is formed by connecting an outdoor unit set with each indoor unit through manifolds, and the outdoor unit set is formed by multiple outdoor units gathered through refrigerant pipes. The outdoor units will be frosted during low-temperature heating, and a heating effect will be affected if the outdoor units are frosted. When a frosting degree of the outdoor unit reaches a certain condition, it is required to defrost the outdoor unit.

When the multi-connection air conditioning system is running, in many cases, only some of the outdoor units in the outdoor unit set need to be turned on at the same time to ensure normal running of the multi-connection air conditioning system. The outdoor units that are running will be frosted, whereas the outdoor units that are not running will not be frosted. In addition, the frosting degrees of the outdoor units having different actual output capacities will also differ greatly. Even when all the outdoor units are running at the same actual output capacities, the frosting degrees of individual outdoor units will also be different due to uneven distribution of refrigerant, etc. As a result, some outdoor units are very seriously frosted, whereas some outdoor units are very slightly frosted.

Since pipelines of the multiple outdoor units are generally directly connected together, if a certain outdoor unit needs to be defrosted, all the outdoor units have to enter a defrosting state. As such, the outdoor units that are not frosted and the outdoor units that are slightly frosted will enter the defrosting state in a case where heating capacities are not fully utilized, resulting in a low utilization efficiency of the heating capacities of the outdoor units, and causing waste of resources.

Accordingly, there is a need in the art for a method for controlling balanced frosting of outdoor units in a multi-connection air conditioning system to solve the above problem.

SUMMARY

In order to solve the above problem in the prior art, that is, to solve the problem that some outdoor units in existing multi-connection air conditioning systems will enter the defrosting state in a case where the heating capacities of the outdoor units are not fully utilized, which results in a low utilization efficiency of the heating capacities of the outdoor units and causes waste of resources, the present disclosure provides a method for controlling balanced frosting of outdoor units in a multi-connection air conditioning system.

The present disclosure provides a method for controlling balanced frosting of outdoor units in a multi-connection air conditioning system, and the method includes: calculating frosting degrees of all outdoor units in an outdoor unit set; judging whether the outdoor unit set satisfies a frosting imbalance condition based on the frosting degrees of all the outdoor units and a preset frosting imbalance threshold; and if the outdoor unit set satisfies the frosting imbalance condition, selectively controlling actual output capacities of the outdoor units in the outdoor unit set based on the frosting degrees of all the outdoor units, and making a total amount of the actual output capacities of all the outdoor units not less than a required total amount of the output capacity of the outdoor unit set.

As a preferred technical solution of the above control method provided by the present disclosure, the step of "judging whether the outdoor unit set satisfies the frosting imbalance condition based on the frosting degrees of all the outdoor units and the preset frosting imbalance threshold" includes: selecting a preset frosting degree reference value as the frosting imbalance threshold when only some of the outdoor units are turned on; comparing the frosting degrees of all the outdoor units in the turned-on state with the preset frosting degree reference value respectively; and if there is any one of all the outdoor units in the turned-on state whose frosting degree is greater than or equal to the preset frosting degree reference value, then determining that the outdoor unit set satisfies the frosting imbalance condition.

As a preferred technical solution of the above control method provided by the present disclosure, the "controlling the actual output capacities of the outdoor units in the outdoor unit set based on the frosting degrees of all the outdoor units" includes: selecting a maximum value of the frosting degrees of all the outdoor units in the turned-on state and a minimum value of the frosting degrees of all the outdoor units in a turned-off state and comparing the maximum value with the minimum value; and controlling the actual output capacities of the outdoor units in the outdoor unit set based on a comparison result.

As a preferred technical solution of the above control method provided by the present disclosure, the "controlling the actual output capacities of the outdoor units in the outdoor unit set based on the comparison result" includes: if the minimum value of the frosting degrees is smaller than the maximum value of the frosting degrees, then turning off the outdoor unit corresponding to the maximum value of the frosting degrees, and turning on the outdoor unit corresponding to the minimum value of the frosting degrees.

As a preferred technical solution of the above control method provided by the present disclosure, the control method further includes: repeating the step of "selecting the maximum value of the frosting degrees of all the outdoor units in the turned-on state and the minimum value of the frosting degrees of all the outdoor units in the turned-off state and comparing the maximum value with the minimum value; and controlling the actual output capacities of the outdoor units in the outdoor unit set based on the comparison result" and the step of "if the minimum value of the frosting degrees is smaller than the maximum value of the frosting degrees, then turning off the outdoor unit corresponding to the maximum value of the frosting degrees, and turning on the outdoor unit corresponding to the minimum value of the frosting degrees" until the frosting degrees of the outdoor units in the turned-on state are each less than the frosting degrees of the outdoor units in the turned-off state.

As a preferred technical solution of the above control method provided by the present disclosure, the step of "judging whether the outdoor unit set satisfies the frosting imbalance condition based on the frosting degrees of all the outdoor units and the preset frosting imbalance threshold" includes: in a case where all the outdoor units in the outdoor unit set are turned on, using a preset standard difference of the frosting degree as the frosting imbalance threshold; calculating a difference between a maximum value of the frosting degrees and a minimum value of the frosting degrees in all the current outdoor units; comparing the difference with the standard difference of the frosting degree; and if the difference is larger than or equal to the standard difference of the frosting degree, then determining that the outdoor unit set satisfies the frosting imbalance condition.

As a preferred technical solution of the above control method provided by the present disclosure, the "selectively controlling the actual output capacities of the outdoor units in the outdoor unit set based on the frosting degrees of all the outdoor units" includes: calculating an average value of the frosting degrees of all the outdoor units; using the average value of the frosting degree as a current frosting degree reference value; or using a sum of the average value of the frosting degrees and a set deviation value as the current frosting degree reference value; and controlling the actual output capacities of the outdoor units in the outdoor unit set based on the frosting degrees of all the outdoor units and the current frosting degree reference value.

As a preferred technical solution of the above control method provided by the present disclosure, the "selectively controlling the actual output capacities of the outdoor units in the outdoor unit set based on the frosting degrees of all the outdoor units and the current frosting degree reference value" includes: reducing the output capacities of the outdoor units whose frosting degrees are greater than the current frosting degree reference value, and/or increasing the output capacities of the outdoor units whose frosting degrees are less than the current frosting degree reference value.

As a preferred technical solution of the above control method provided by the present disclosure, the "calculating the frosting degrees of all the outdoor units in the outdoor unit set" includes making a statistic on an actual duration in which a temperature of a condenser of the outdoor unit is lower than a preset temperature threshold; and calculating a ratio of the actual duration to a preset duration as the frosting degree of the outdoor unit.

As a preferred technical solution of the above control method provided by the present disclosure, the control method further includes: controlling all the outdoor units in the outdoor unit set to enter a defrosting state, if there is any outdoor unit in the outdoor unit set whose frosting degree reaches a defrosting condition.

In the method for controlling balanced frosting of outdoor units in a multi-connection air conditioning system provided by the present disclosure, it is judged whether the outdoor unit set satisfies the frosting imbalance condition, and then based on the frosting degrees of all the outdoor units, the actual output capacities of the outdoor units in the outdoor unit set are selectively controlled under the premise of ensuring that the total amount of the actual output capacities of all the outdoor units is not less than a required total amount of the output capacity of the outdoor unit set. In this way, the difference in the frosting degrees of different outdoor units in the outdoor unit set at the same time can be reduced, so that when the outdoor unit set enters the defrosting state, the heating capacities of all the outdoor units can be fully utilized.

In addition, for two different situations in which only some of the outdoor units in the outdoor unit set are turned on and all the outdoor units in the outdoor unit set are turned on, the present disclosure proposes different control methods respectively, so that the method for controlling balanced frosting of outdoor units in a multi-connection air conditioning system provided by the present disclosure can be adapted to different application scenes, and further ensures the application effect of the method for controlling balanced frosting of outdoor units in a multi-connection air conditioning system provided by the present disclosure.

BRIEF DESCRIPTION OF DRAWINGS

In the following, the method for controlling balanced frosting of outdoor units in a multi-connection air conditioning system according to the present disclosure will be described with reference to the accompanying drawings. In the drawings.

DETAILED DESCRIPTION

Preferred embodiments of the present disclosure will be described below with reference to the accompanying drawings. It should be understood by those skilled in the art that these embodiments are only used to explain the technical principles of the present disclosure, and are not intended to limit the scope of protection of the present disclosure. For example, although the method for controlling balanced frosting of outdoor units in a multi-connection air conditioning system is described in this embodiment in combination with two scenes in which only some of the outdoor units in the outdoor unit set are turned on and all the outdoor units in the outdoor unit set are turned on, this is not intended to limit the scope of protection of the present disclosure. Without departing from the principles of the present disclosure, in order to achieve the effect of this embodiment, those skilled in the art may make various combinations and adjustments to the steps of this embodiment, and the steps may be executed simultaneously (in parallel) or in a reverse order. Such simple changes are all within the scope of protection of the present disclosure.

Figure 2:
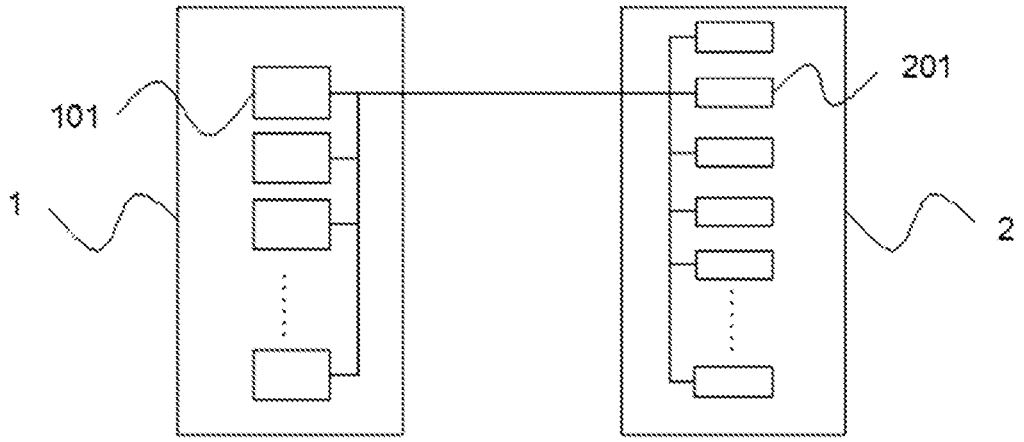
FIG. 2 is a schematic structural diagram of the multi-connection air conditioning system of this embodiment.

First, reference is made to FIG. 2, which is a schematic structural diagram of a multi-connection air conditioning system. As shown in FIG. 2, the existing multi-connection air conditioning system is formed by connecting an outdoor unit set 1 to individual indoor unit systems 2 through manifolds. The outdoor unit set 1 is formed by multiple outdoor units 101 gathered through refrigerant pipes, whereas the indoor unit system 2 is composed of indoor units 201 distributed in different rooms of user. The outdoor units 101 will be frosted during low-temperature heating, and a heating effect will be affected if the outdoor units 101 are frosted. When a frosting degree of the outdoor unit 101 reaches a certain condition, it is required to defrost the outdoor unit 101.

However, as described in the "BACKGROUND", When the multi-connection air conditioning system is running, in many cases, only some of the outdoor units in the outdoor unit set need to be turned on at the same time to ensure normal running of the multi-connection air conditioning system. The outdoor units that are running will be frosted, whereas the outdoor units that are not running will not be frosted. In addition, the frosting degrees of the outdoor units having different actual output capacities will also differ greatly. Even when all the outdoor units are running at the same actual output capacities, the frosting degrees of individual outdoor units will also be different due to uneven distribution of refrigerant, etc. As a result, some outdoor units are very seriously frosted, whereas some outdoor units are very slightly frosted. If a certain outdoor unit needs to be defrosted, all the outdoor units have to enter a defrosting state. As such, the outdoor units that are not frosted and the outdoor units that are slightly frosted will enter the defrosting state in a case where heating capacities are not fully utilized, resulting in a low utilization efficiency of the heating capacities of the outdoor units, and causing waste of resources.

In order to solve the problem that some outdoor units in existing multi-connection air conditioning systems will enter the defrosting state in a case where the heating capacities of the outdoor units are not fully utilized, which results in a low utilization efficiency of the heating capacities of the outdoor units and causes waste of resources, this embodiment provides a method for controlling balanced frosting of outdoor units in a multi-connection air conditioning system.

Figure 1:
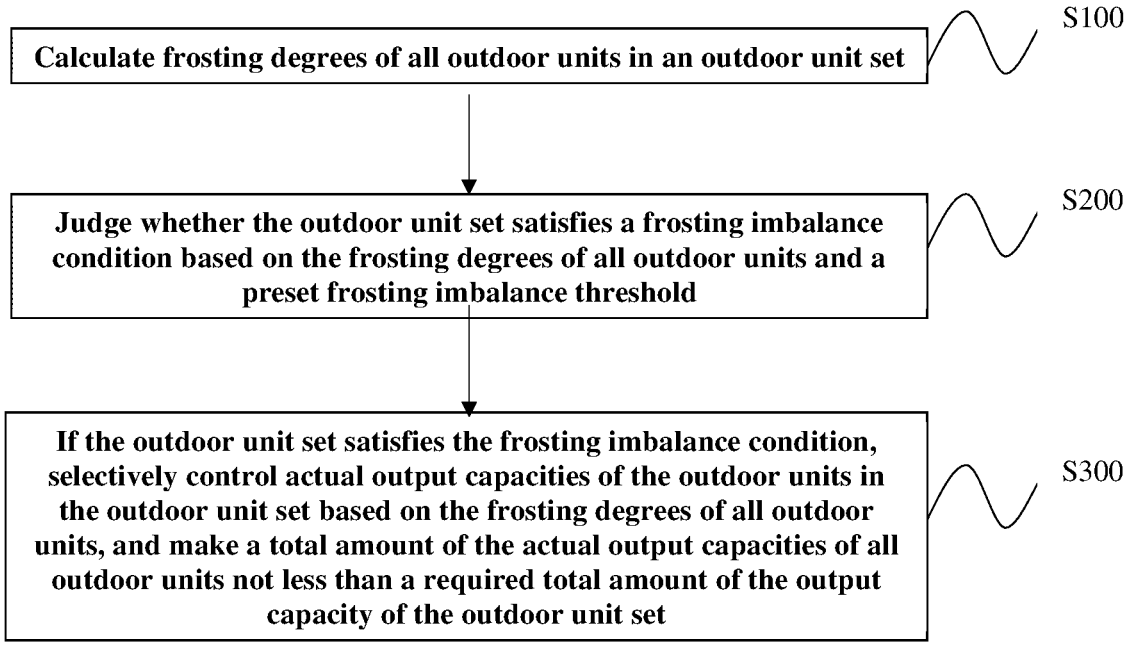
FIG. 1 is a schematic flowchart of a method for controlling balanced frosting of outdoor units in a multi-connection air conditioning system according to an embodiment.

As shown in FIG. 1, this embodiment provides a method for controlling balanced frosting of outdoor units in a multi-connection air conditioning system, and the method includes:

S100: calculating frosting degrees of all outdoor units in an outdoor unit set;

S200: judging whether the outdoor unit set satisfies a frosting imbalance condition based on the frosting degrees of all the outdoor units and a preset frosting imbalance threshold; and S300: if the outdoor unit set satisfies the frosting imbalance condition, selectively controlling actual output capacities of the outdoor units in the outdoor unit set based on the frosting degrees of all the outdoor units, and making a total amount of the actual output capacities of all the outdoor units not less than a required total amount of the output capacity of the outdoor unit set.

Exemplarily, when the outdoor unit is turned on, as the heating of the outdoor unit proceeds, the frosting degree of the outdoor unit will gradually increase. In this embodiment, it is judged whether the outdoor unit set satisfies the frosting imbalance condition by setting a frosting imbalance threshold. If the outdoor unit set satisfies the frosting imbalance condition, it indicates that the frosting degrees of the outdoor units have a large difference. If the actual output capacities of the outdoor units are not controlled, the utilization efficiency of the heating capacities of the outdoor units will be low when the outdoor units wholly enter the defrosting state, resulting in a waste of resources. Therefore, it is then necessary to adjust the output capacities of multiple outdoor units in the outdoor unit set.

The required amount of the total capacity in this embodiment is the required amount of the total cooling capacity, which is related to factors such as compressor frequency, fan speed, and electric heating power. The parameter "output capacity" of the outdoor unit generally has a nominal value in the outdoor unit, and the nominal amount of output capacity is the maximum cooling capacity or maximum heating capacity per unit time. The actual output capacity in this embodiment mainly refers to a ratio of the actual heating capacity per unit time to the nominal maximum heating capacity, expressed as a percentage. When the outdoor unit is turned off, its actual output capacity is 0.

Since the output capacity of the outdoor unit needs to meet the requirement of the indoor unit, when adjusting the output capacity of the outdoor unit, the total amount of the actual output capacities of all the outdoor units has to be no less than a required total amount of the output capacity of the outdoor unit set. It should be noted that the output capacity of the outdoor unit will change over time. For example, the required total amount of the output capacity of the outdoor unit set at night is lower than that during the daytime; the required total amount of the output capacity of the outdoor unit set may also be a fixed value, such as a maximum value of the required total amount of the outdoor units in a day. In order to clearly explain the method for controlling balanced frosting of outdoor units in a multi-connection air conditioning system of this embodiment, it is assumed in this embodiment that the required total amount of the output capacity of the outdoor unit set remains unchanged during the process of controlling the output capacity of the outdoor unit set.

In the above method for controlling balanced frosting of outdoor units in a multi-connection air conditioning system provided by this embodiment, it is judged whether the outdoor unit set satisfies the frosting imbalance condition, and then based on the frosting degrees of all the outdoor units, the actual output capacities of the outdoor units in the outdoor unit set are selectively controlled under the premise of ensuring that the total amount of the actual output capacities of all the outdoor units is not less than a required total amount of the output capacity of the outdoor unit set. In this way, the difference in the frosting degrees of different outdoor units in the outdoor unit set at the same time is reduced, so that when the outdoor unit set enters the defrosting state, the heating capacities of all the outdoor units can be fully utilized.

In the following, an exemplary description of the method for controlling balanced frosting of outdoor units in a multi-connection air conditioning system of the present disclosure will be given in combination with two specific embodiments.

A First Embodiment

In this embodiment, an implementation of the above control method will be described in combination with data in table 1.

As one of the optional implementations in the above embodiment, the step of "judging whether the outdoor unit set satisfies the frosting imbalance condition based on the frosting degrees of all the outdoor units and the preset frosting imbalance threshold" in step S200 includes: selecting a preset frosting degree reference value as the frosting imbalance threshold when only some of the outdoor units are turned on; comparing the frosting degrees of all the outdoor units in the turned-on state with the preset frosting degree reference value respectively; and if there is any one of all the outdoor units in the turned-on state whose frosting degree is greater than or equal to the preset frosting degree reference value, then determining that the outdoor unit set satisfies the frosting imbalance condition.

Exemplarily, the preset frosting degree reference value determines under what circumstances it is necessary to selectively control the actual output capacities of the outdoor units in the outdoor unit set, and the preset frosting degree reference value may theoretically be smaller than any value below a defrosting condition. Herein, the defrosting condition means that the frosting degree reaches 100%; however, in practice, in order to improve the efficiency of adjusting the outdoor units, the preset frosting degree reference value may generally be chosen within a range from 20% to 70%. In this embodiment, the preset frosting degree reference value is chosen as 40%.

TABLE 1

| example of a control process of the outdoor units when only some of the outdoor units are turned on | | | | |
|---|---|---|---|---|
| case | outdoor unit 1 running state/ frosting degree | outdoor unit 2 running state/ frosting degree | outdoor unit 3 running state/ frosting degree | outdoor unit 4 running state/ frosting degree |
| 1 | ON/40% | ON/35% | OFF/36% | OFF/30% |
| 2 | OFF/40% | ON/35% | OFF/36% | ON/30% |
| 3 | ON/45% | ON/40% | OFF/36% | OFF/35% |
| 4 | OFF/45% | OFF/40% | ON/36% | ON/35% |
| 5 | OFF/40% | OFF/40% | ON/40% | ON/38% |

As shown in table 1, the frosting degrees of the outdoor units obtained in step S100 are shown. As shown in case 1, there are a total of 4 outdoor units, of which outdoor unit 1 and outdoor unit 2 are both in a turned-on state, and outdoor unit 3 and outdoor unit 4 are both in a turned-off state. In order to facilitate the description of the implementations of this embodiment, it is first assumed that the actual output capabilities of all the outdoor units in the turned-on state are the same. The frosting degree of the outdoor unit 1 is 40%, the frosting degree of the outdoor unit 2 is 35%, the frosting degree of the outdoor unit 3 is 36%, and the frosting degree of the outdoor unit 4 is 30%. According to step S200, it is judged whether the outdoor unit set satisfies the frosting imbalance condition based on the frosting degrees of all the outdoor units and the preset frosting imbalance threshold. The frosting degree of the outdoor unit 1 in the turned-on state is equal to the preset frosting degree reference value 40%, so it can be seen that the outdoor unit set satisfies the frosting imbalance condition.

In the implementation of this embodiment, in step S300, the "selectively controlling the actual output capacities of the outdoor units in the outdoor unit set based on the frosting degrees of all the outdoor units" includes: selecting a maximum value of the frosting degrees of all the outdoor units in the turned-on state and a minimum value of the frosting degrees of all the outdoor units in a turned-off state and comparing the maximum value with the minimum value; and controlling the actual output capacities of the outdoor units in the outdoor unit set based on a comparison result.

Exemplarily, as shown in the case 1 of table 1, the maximum value of the frosting degrees in the outdoor unit 1 and the outdoor unit 2 in the turned-on state is 40%, and the minimum value of the frosting degrees in the outdoor unit 3 and the outdoor unit 4 in the turned-off state is 30%. The comparison result is that the frosting degree of the outdoor unit 4 in the turned-off state is less than the frosting degree of the outdoor unit 1 in the turned-on state.

As a preferred implementation of the above control method provided by this embodiment, the "controlling the actual output capacities of the outdoor units in the outdoor unit set based on the comparison result" includes: if the minimum value of the frosting degrees is smaller than the maximum value of the frosting degrees, then turning off the outdoor unit corresponding to the maximum value of the frosting degrees, and turning on the outdoor unit corresponding to the minimum value of the frosting degrees.

Exemplarily, as shown in case 2 in table 1, the result of controlling the actual output capacities of the outdoor units in the outdoor unit set is that the outdoor unit 1 with the highest frosting degree is turned off, and the outdoor unit 4 with the least frosting degree is turned on. It can be understood by those skilled in the art that the purpose of turning on one outdoor unit and turning off one outdoor unit in a case where the actual output capabilities of the outdoor units in the turned-on state are the same is to ensure that the total amount of the actual output capacities of all the outdoor units is not less than the required total amount of the output capacity of the outdoor unit set. At this time, if the actual output capacity after the outdoor unit 4 is turned on is greater than the actual output capacity when the outdoor unit 1 was originally in the turned-on state, the total amount of the actual output capacities of all the outdoor units can be also made not less than the required total amount of the output capacity of the outdoor unit set.

As a preferred implementation of the above control method provided by this embodiment, the control method further includes: repeating the step of "selecting the maximum value of the frosting degrees of all the outdoor units in the turned-on state and the minimum value of the frosting degrees of all the outdoor units in the turned-off state and comparing the maximum value with the minimum value; and controlling the actual output capacities of the outdoor units in the outdoor unit set based on the comparison result" and the step of "if the minimum value of the frosting degrees is smaller than the maximum value of the frosting degrees, then turning off the outdoor unit corresponding to the maximum value of the frosting degrees, and turning on the outdoor unit corresponding to the minimum value of the frosting degrees" until the frosting degrees of the outdoor units in the turned-on state are each less than the frosting degrees of the outdoor units in the turned-off state.

Exemplarily, after the actual output capacities of the outdoor units are controlled, the case 1 becomes the case 2. At this time, the frosting degrees of the outdoor unit 2 and the outdoor unit 4 in the turned-on state is each less than the frosting degrees of the outdoor unit 1 and the outdoor unit 3 in the turned-off state. Therefore, it is not necessary to perform the above repeating steps.

As another example, in case 3 in table 1, the frosting degrees of all the outdoor units are obtained according to step S100. The frosting degree of the outdoor unit 1 is 45%, the frosting degree of the outdoor unit 2 is 40%, the frosting degree of the outdoor unit 3 is 36%, and the frosting degree of the outdoor unit 4 is 35%.

According to step S200, it is judged whether the outdoor unit set satisfies the frosting imbalance condition based on the frosting degrees of all the outdoor units and the preset frosting imbalance threshold. The frosting degree of the outdoor unit 1 in the turned-on state is 45%, which is larger than the preset frosting degree reference value of 40%, and the frosting degree of the outdoor unit 2 in the turned-on state is 40%, which is equal to the preset frosting degree reference value of 40%. Therefore, it can be seen that the outdoor unit set satisfies the frosting imbalance condition. The maximum value of the frosting degrees of the outdoor unit 1 and the outdoor unit 2 in the turned-on state is 45%, and the minimum value of the frosting degrees of the outdoor unit 3 and the outdoor unit 4 in the turned-off state is 35%.

According to step S300, the actual output capacities of the outdoor units in the outdoor unit set are selectively controlled based on the frosting degrees of all the outdoor units, and the comparison result is that the frosting degree of the outdoor unit 4 in the turned-off state is less than the frosting degree of the outdoor unit 1 in the turned-on state. Therefore, the specific process of controlling the actual output capacities of the outdoor units in the outdoor unit set is to turn off the outdoor unit 1 with the greatest frosting degree, and turn on the outdoor unit 4 with the least frosting degree.

However, out of the outdoor units in the turned-on state at this time, the frosting degree of the outdoor unit 2 is 40%, and the frosting degree of the outdoor unit 4 is 35%; therefore, out of the outdoor units in the turned-on state, the outdoor unit 2 has the greatest frosting degree, and the corresponding maximum value of the frosting degrees is 40%; out of the outdoor units in the turned-off state, the frosting degree of the outdoor unit 1 is 45%, and the frosting degree of the outdoor unit 3 is 36%; therefore, out of the outdoor units in the turned-off state, the outdoor unit 3 has the least frosting degree, and the corresponding minimum value of the frosting degrees is 36%. By comparing the maximum value of the frosting degrees of 40% in all the outdoor units in the turned-on state with the minimum value of the frosting degrees of 36% in all the outdoor units in the turned-off state, it can be seen that the minimum value of the frosting degrees of 36% is smaller than the maximum value of the frosting degrees of 40%. Therefore, the outdoor unit 2 corresponding to the maximum value of the frosting degrees is turned off, and the outdoor unit 3 corresponding to the minimum value of the frosting degrees is turned on, which becomes the case 4. Till now, the frosting degrees of the outdoor units in the turned-on state are each less than the frosting degrees of the outdoor units in the turned-off state.

As another example, in case 5 in table 1, the frosting degree of the outdoor unit 3 in the turned-on state is 40%, and it can be seen that the outdoor unit set satisfies the frosting imbalance condition. However, the frosting degrees of the outdoor unit 1 and the outdoor unit 2 in the turned-off state are also each 40%, which is not less than the frosting degree of the outdoor unit 3. Therefore, the outdoor unit 3 can only continue to run at this time. When the frosting degree of the outdoor unit 3 in the turned-on state is greater than 40% in the next-time detection, the outdoor unit corresponding to the minimum value of the frosting degrees in the turned-off state can be chosen and turned on; that is, the frosting degree of the outdoor unit 3 in the turned-off state at this time is greater than 40%.

It can be seen that when the outdoor unit satisfies the frosting imbalance condition, there is also a case in which the outdoor unit is not controlled and is allowed to continue to run normally. This example can be used as an exemplary description of the case of not controlling the actual output capacities of the outdoor units in the outdoor unit set included in step S300 of "selectively controlling the actual output capacities of the outdoor units in the outdoor unit set".

A Second Embodiment

In this embodiment, an implementation of the above control method will be described in combination with data in table 2.

As one of the optional implementations in the above embodiment, the step of S200 "judging whether the outdoor unit set satisfies the frosting imbalance condition based on the frosting degrees of all the outdoor units and the preset frosting imbalance threshold" includes: in a case where all the outdoor units in the outdoor unit set are turned on, using a preset standard difference of the frosting degree as the frosting imbalance threshold; calculating a difference between the maximum value of the frosting degrees and the minimum value of the frosting degrees in all the current outdoor units; comparing the difference with the standard difference of the frosting degree; and if the difference is larger than or equal to the standard difference of the frosting degree, then determining that the outdoor unit set satisfies the frosting imbalance condition.

Exemplarily, the preset standard difference of the frosting degree determines under what circumstances it is necessary to selectively control the actual output capacities of the outdoor units in the outdoor unit set. The larger the preset standard difference of the frosting degree is, the less the number of times of controlling the actual output capacities of the outdoor units as required will be; and the smaller the preset standard difference of the frosting degree is, the more frequently the actual output capacities of the outdoor units will be controlled, and the frosting degrees of different outdoor units will become more balanced. Those skilled in the art may select a reasonable value according to the specific situation, and it is recommended to select the preset standard difference of the frosting degree as 5%-10%. In this embodiment, the preset standard difference of the frosting degree is selected as 5%.

As shown in table 2, the frosting degrees of the outdoor units are obtained according to step S100. As shown in case A, when the actual output capacities of the outdoor unit 1, the outdoor unit 2, the outdoor unit 3 and the outdoor unit 4 are all 50%, the outdoor unit 4 has the maximum frosting degree, which is 65%, and the outdoor unit 3 has the minimum frosting degree, which is 46%. Correspondingly, in step S200, the difference between the maximum value of the frosting degree and the minimum value of the frosting degree is 19%, which is larger than the standard difference of the frosting degree of 5%. Therefore, the outdoor unit set in case A satisfies the frosting imbalance condition.

TABLE 2 example of a control process of the outdoor units when all the outdoor units are turned on

| case | outdoor unit 1 actual output capacity/ frosting degree | outdoor unit 2 actual output capacity/ frosting degree | outdoor unit 3 actual output capacity/ frosting degree | outdoor unit 4 actual output capacity/ frosting degree |
|---|---|---|---|---|
| A | 50%/50% | 50%/55% | 50%/46% | 50%/65% |
| B | 51%/50% | 50%/55% | 51%/46% | 48%/65% |
| C | 51%/60% | 50%/57% | 51%/53% | 48%/66% |
| D | 51%/60% | 51%/57% | 52%/53% | 46%/66% |
| E | 51%/98% | 51%/99% | 52%/98% | 46%/100% |
| F | 100%/80% | 100%/87% | 100%/90% | 100%/85% |

The "selectively controlling the actual output capacities of the outdoor units in the outdoor unit set based on the frosting degrees of all the outdoor units" in step S300 includes: calculating an average value of the frosting degrees of all the outdoor units; using the average value of the frosting degree as a current frosting degree reference value; or using a sum of the average value of the frosting degrees and a set deviation value as the current frosting degree reference value; and controlling the actual output capacities of the outdoor units in the outdoor unit set based on the frosting degrees of all the outdoor units and the current frosting degree reference value.

Exemplarily, in case A in table 2, the average value of the frosting degrees of all the outdoor units is calculated, which is 54%, and the deviation value is set to be 1%, so the current frosting degree reference value is 55%. Therefore, it is necessary to control the actual output capacities of the outdoor units according to the frosting degree of each outdoor unit of 50%, 55%, 46% and 65% and the current frosting degree reference value of 55%.

As a preferred implementation of the above control method provided by the embodiment, the "selectively controlling the actual output capacities of the outdoor units in the outdoor unit set based on the frosting degrees of all the outdoor units and the current frosting degree reference value" includes: reducing the output capacities of the outdoor units whose frosting degrees are greater than the current frosting degree reference value, and/or increasing the output capacities of the outdoor units whose frosting degrees are less than the current frosting degree reference value.

Exemplarily, the actual output capacities of the outdoor units are controlled based on the frosting degrees of the outdoor units in the case A and the above current frosting degree reference value of 55%. When reducing the output capacities of the outdoor units whose frosting degrees are greater than the current frosting degree reference value, the greater the reduction is, the smaller the actual output capacity of the outdoor unit and the lower the frosting speed will be. When controlling the actual output capacities of the outdoor units, it is recommended that the actual output capacity of the outdoor unit be generally reduced by only 1% to 5%. In this embodiment, an example will be used for description in which the output capacity of the outdoor unit whose frosting degree is greater than the current frosting degree reference value is reduced by 2%.

The actual output capacity of the outdoor unit 4 whose frosting degree is greater than the current frosting degree reference value of 55% is reduced by 2%, the actual output capacity of the outdoor unit 2 whose frosting degree is equal to the current frosting degree reference value of 55% remains unchanged, and the actual output capacities of the outdoor unit 1 and the outdoor unit 3 whose frosting degrees are less than the current frosting degree reference value of 55% are each increased by 1%, so that the total amount of the actual output capacities of all the outdoor units is not affected.

The frosting degrees of the outdoor units in the outdoor unit set may be obtained every other certain period (e.g., 5 minutes), and based on the frosting degrees of all the outdoor units, the actual output capacities of the outdoor units in the outdoor unit set can be selectively controlled.

As another example, the frosting degrees of the outdoor units are obtained according to step S100. As shown in case C in table 2, the outdoor unit 4 has the greatest frosting degree, which is 66%, and the outdoor unit 3 has the least frosting degree, which is 53%.

According to step S200, it is judged whether the outdoor unit set satisfies the frosting imbalance condition based on the frosting degrees of all the outdoor units and the preset frosting imbalance threshold. The difference between the maximum value of the frosting degrees and the minimum value of the frosting degrees is 13%, which is larger than the standard difference of the frosting degree of 5%. Therefore, the outdoor unit set in case C satisfies the frosting imbalance condition.

According to step S300, the actual output capacities of the outdoor units in the outdoor unit set are selectively controlled based on the frosting degrees of all the outdoor units. In the case C of table 2, the average value of the frosting degrees of all the outdoor units is 59%, and the deviation value is set to be 1%, so the current frosting degree reference value is 60%. Therefore, it is necessary to control the actual output capacities of the outdoor units according to the frosting degree of each outdoor unit of 60%, 57%, 53% and 66% and the current frosting degree reference value of 60%.

The actual output capacity of the outdoor unit 4 whose frosting degree is greater than the current frosting degree reference value of 60% is reduced by 2%, the actual output capacity of the outdoor unit 1 whose frosting degree is equal to the current frosting degree reference value of 60% remains unchanged, and the actual output capacities of the outdoor unit 2 and the outdoor unit 3 whose frosting degrees are less than the current frosting degree reference value of 60% are each increased by 1%, so that the total amount of the actual output capacities of all the outdoor units is not affected.

As another example, the frosting degrees of the outdoor units are obtained according to step S100. As shown in case D in table 2, the outdoor unit 3 has the greatest frosting degree, which is 90%, and the outdoor unit 1 has the least frosting degree, which is 80%. Correspondingly, in step S200, the difference between the maximum value of the frosting degrees and the minimum value of the frosting degrees is 10%, which is larger than the standard difference of the frosting degree of 5%. Therefore, the outdoor unit set in case C satisfies the frosting imbalance condition. However, since the actual output capacities of all the outdoor units have all reached 100% at this time, there is no need to adjust the actual output capacities of the outdoor units. The outdoor unit set continues to run until it satisfies the defrosting condition and enters the defrosting state.

It can be seen that when the outdoor unit satisfies the frosting imbalance condition, there is also a case in which the outdoor unit is not controlled and is allowed to continue to run normally. This example can be used as an exemplary description of the case of not controlling the actual output capacities of the outdoor units in the outdoor unit set included in step S300 of "selectively controlling the actual output capacities of the outdoor units in the outdoor unit set".

This embodiment proposes different control methods for two different situations in which only some of the outdoor units in the outdoor unit set are turned on and all the outdoor units in the outdoor unit set are turned on respectively, so that the method for controlling balanced frosting of outdoor units in a multi-connection air conditioning system proposed by this embodiment can be adapted to different application scenes, which further ensures the application effect of the method for controlling balanced frosting of outdoor units in a multi-connection air conditioning system provided by this embodiment.

As a preferred implementation of the above control method provided by this embodiment, the "calculating the frosting degrees of all the outdoor units in the outdoor unit set" includes making a statistic on an actual duration in which a temperature of a condenser of the outdoor unit is lower than a preset temperature threshold; and calculating a ratio of the actual duration to a preset duration as the frosting degree of the outdoor unit.

As a preferred implementation of the above control method provided by this embodiment, the control method further includes: controlling all the outdoor units in the outdoor unit set to enter a defrosting state, if there is any outdoor unit in the outdoor unit set whose frosting degree reaches a defrosting condition.

Exemplarily, the defrosting condition is that the frosting degree reaches 100%. The method for calculating the frosting degree is to make a statistic on an actual duration in which a temperature of a condenser of the outdoor unit is lower than a preset temperature threshold, and calculate a ratio of the actual duration to a preset duration as the frosting degree of the outdoor unit. For example, the defrosting condition may be that a cumulative time during which the temperature of the outdoor unit is lower than −10° C. reaches 50 minutes, that is, the frosting degree reaches 100%. When the cumulative time during which the temperature of the outdoor unit is lower than −10° C. reaches 20 minutes, the frosting degree of the outdoor unit is correspondingly 40%.

It can be understood by those skilled in the art that although the embodiments of the method for controlling balanced frosting of outdoor units in a multi-connection air conditioning system are described in combination with two different situations in which only some of the outdoor units in the outdoor unit set are turned on and all the outdoor units in the outdoor unit set are turned on, this is not intended to limit the scope of protection of this application. Those skilled in the art may adjust it based on actual application scenes, as long as the actual output capacities of the outdoor units in the outdoor unit set are selectively controlled based on the frosting degrees of all the outdoor units, and a total amount of the actual output capacities of all the outdoor units can be made not less than a required total amount of the output capacity of the outdoor unit set.

For example, in another alternative embodiment, the actual output capacities of the outdoor units can be adjusted by adjusting operating frequencies of the outdoor units.

For another example, in another alternative embodiment, the method of calculating the frosting degree of the outdoor unit in step S100 may also be: judging the frosting degree of the outdoor unit by obtaining any parameter value of a wind pressure of the outdoor unit, a wind speed of the outdoor unit, a current of the outdoor unit and a rotational speed of the outdoor unit when the temperature of the outdoor unit is lower than a preset temperature when the outdoor unit of the air conditioner is in a heating mode. The preset temperature can be calibrated according to the actual situation; for example, the preset temperature may be various preset values such as 0° C., −10° C., etc.

The specific judging method is to set multiple thresholds in advance, and then compare the actually obtained parameter values with the multiple thresholds respectively to determine the frosting degrees of the outdoor units. The wind pressure of the outdoor unit may be detected by a wind pressure sensor installed on a heat exchanger of the outdoor unit, the wind speed of the outdoor unit may be detected by a wind speed sensor installed on the heat exchanger of the outdoor unit, the current of the outdoor unit may be detected by a current sensor, and the rotational speed of the outdoor unit may be detected by a rotational speed sensor.

As another example, in another alternative embodiment, the maximum value of the frosting degrees and the minimum value of the frosting degrees of all the outdoor units may be obtained, and the outdoor unit corresponding to the maximum value of the frosting degrees may be turned off accordingly, or the actual output capacity of the outdoor unit corresponding to the maximum value of the frosting degrees in the turned-on state may be reduced; at the same time, the outdoor unit corresponding to the minimum value of the frosting degrees may be turned on, or the actual output capacity of the outdoor unit corresponding to the maximum value of the frosting degrees in the turned-on state may be increased.

It should be noted that although the detailed steps of the method of the present disclosure have been described in detail above, those skilled in the art may combine, split and exchange the order of the above steps without departing from the basic principles of the present disclosure. The technical solutions after such modifications do not change the basic concept of the present disclosure, so they will also fall within the scope of protection of the present disclosure.

It should be understood by those skilled in the art that the method for controlling balanced frosting of outdoor units in a multi-connection air conditioning system provided by this embodiment may be stored as a program in a computer readable storage medium. The storage medium includes several instructions that enable a computer device (which may be a personal computer, a server, or a network device, etc.) or a processor to execute some steps of the methods in various embodiments of the present disclosure. The above storage medium includes: a U disk, a mobile hard disk, a read-only memory (ROM), a random access memory (RAM), a magnetic disk or an optical disk and other media that can store program codes.

Hitherto, preferred implementations of the present disclosure have been described in conjunction with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A method for controlling balanced frosting of outdoor units in a multi-connection air conditioning system, the method comprising:

calculating frosting degrees of all outdoor units in an outdoor unit set;

judging whether the outdoor unit set satisfies a frosting imbalance condition based on the frosting degrees of all the outdoor units and a preset frosting imbalance threshold; and when the outdoor unit set satisfies the frosting imbalance condition, selectively controlling actual output capacities of the outdoor units in the outdoor unit set based on the frosting degrees of all the outdoor units, and making a total amount of the actual output capacities of all the outdoor units not less than a required total amount of the output capacity of the outdoor unit set.

2. The control method according to claim 1, wherein the step of judging whether the outdoor unit set satisfies the frosting imbalance condition based on the frosting degrees of all the outdoor units and the preset frosting imbalance threshold comprises:

selecting a preset frosting degree reference value as the frosting imbalance threshold when only some of the outdoor units are turned on;

comparing the frosting degrees of all the outdoor units in the turned-on state with the preset frosting degree reference value respectively; and if there is any one of all the outdoor units in the turned-on state whose frosting degree is greater than or equal to the preset frosting degree reference value, then determining that the outdoor unit set satisfies the frosting imbalance condition.

3. The control method according to claim 2, wherein the controlling the actual output capacities of the outdoor units in the outdoor unit set based on the frosting degrees of all the outdoor units comprises:

selecting a maximum value of the frosting degrees of all the outdoor units in the turned-on state and a minimum value of the frosting degrees of all the outdoor units in a turned-off state and comparing the maximum value with the minimum value; and controlling the actual output capacities of the outdoor units in the outdoor unit set based on a comparison result.

4. The control method according to claim 3, wherein the controlling the actual output capacities of the outdoor units in the outdoor unit set based on the comparison result comprises:

if the minimum value of the frosting degrees is smaller than the maximum value of the frosting degrees, then turning off the outdoor unit corresponding to the maximum value of the frosting degrees, and turning on the outdoor unit corresponding to the minimum value of the frosting degrees.

5. The control method according to claim 4, further comprising:

repeating the steps of:

selecting a maximum value of the frosting degrees of all the outdoor units in the turned-on state and a minimum value of the frosting degrees of all the outdoor units in a turned-off state and comparing the maximum value with the minimum value;

controlling the actual output capacities of the outdoor units in the outdoor unit set based on a comparison result; and if the minimum value of the frosting degrees is smaller than the maximum value of the frosting degrees, then turning off the outdoor unit corresponding to the maximum value of the frosting degrees, and turning on the outdoor unit corresponding to the minimum value of the frosting degrees;

until the frosting degrees of the outdoor units in the turned-on state are each less than the frosting degrees of the outdoor units in the turned-off state.

6. The control method according to claim 1, wherein the step of judging whether the outdoor unit set satisfies the frosting imbalance condition based on the frosting degrees of all the outdoor units and the preset frosting imbalance threshold comprises:

in a case where all the outdoor units in the outdoor unit set are turned on, using a preset standard difference of the frosting degree as the frosting imbalance threshold;

calculating a difference between a maximum value of the frosting degrees and a minimum value of the frosting degrees in all the current outdoor units;

comparing the difference with the standard difference of the frosting degree; and if the difference is larger than or equal to the standard difference of the frosting degree, then determining that the outdoor unit set satisfies the frosting imbalance condition.

7. The control method according to claim 6, wherein the controlling the actual output capacities of the outdoor units in the outdoor unit set based on the frosting degrees of all the outdoor units comprises:

calculating an average value of the frosting degrees of all the outdoor units;

using the average value of the frosting degree as a current frosting degree reference value; or using a sum of the average value of the frosting degrees and a set deviation value as the current frosting degree reference value; and controlling the actual output capacities of the outdoor units in the outdoor unit set based on the frosting degrees of all the outdoor units and the current frosting degree reference value.

8. The control method according to claim 7, wherein the controlling the actual output capacities of the outdoor units in the outdoor unit set based on the frosting degrees of all the outdoor units and the current frosting degree reference value comprises:

reducing the output capacities of the outdoor units whose frosting degrees are greater than the current frosting degree reference value, and/or increasing the output capacities of the outdoor units whose frosting degrees are less than the current frosting degree reference value.

9. The control method according to claim 1, wherein the calculating the frosting degrees of all the outdoor units in the outdoor unit set comprises:

making a statistic on an actual duration in which a temperature of a condenser of the outdoor unit is lower than a preset temperature threshold; and calculating a ratio of the actual duration to a preset duration as the frosting degree of the outdoor unit.

10. The control method according to claim 1, further comprising:

controlling all the outdoor units in the outdoor unit set to enter a defrosting state, if there is any outdoor unit in the outdoor unit set whose frosting degree reaches a defrosting condition.

* * * * *